US005117160A

United States Patent [19]

Konda et al.

[11] Patent Number: 5,117,160

[45] Date of Patent: May 26, 1992

[54] RARE GAS DISCHARGE LAMP

[75] Inventors: Tsutomu Konda; Seiichiro Fujioka; Satoshi Tamura; Osamu Matsubara; Shodo Yoshida, all of Osaka, Japan

[73] Assignee: NEC Corporation, Tokyo, Japan

[21] Appl. No.: 540,326

[22] Filed: Jun. 19, 1990

[30] Foreign Application Priority Data

| | | | |
|---|---|---|---|
| Jun. 23, 1989 | [JP] | Japan | 1-161958 |
| Sep. 29, 1989 | [JP] | Japan | 1-115236[U] |
| Dec. 29, 1989 | [JP] | Japan | 1-340171 |
| Mar. 28, 1990 | [JP] | Japan | 2-80486 |

[51] Int. Cl.[5] ..... H01J 11/04

[52] U.S. Cl. ..... 315/326; 313/607

[58] Field of Search ..... 313/607, 488, 493; 315/326

[56] References Cited

U.S. PATENT DOCUMENTS

| | | | |
|---|---|---|---|
| 3,826,946 | 7/1974 | Hammer | 313/607 |
| 4,871,941 | 10/1989 | Dobashi | 313/488 |
| 4,899,090 | 2/1990 | Yoshiike et al. | 315/335 |
| 4,906,891 | 3/1990 | Takagi et al. | 315/318 |
| 4,909,604 | 3/1990 | Kobayashi et al. | 350/345 |

FOREIGN PATENT DOCUMENTS 60-12660 1/1985 Japan .

*Primary Examiner*—Eugene R. LaRoche
*Assistant Examiner*—R. A. Ratliff
*Attorney, Agent, or Firm*—Laff, Whitesel, Conte & Saret

[57] ABSTRACT

A phosphor layer is coated on an inner wall of a tubular glass bulb. A predetermined amount of a rare gas containing xenon gas as a main component thereof is sealed and enclosed in the tubular glass bulb. A pair of belt-shaped electrodes are formed on an outer wall of the enclosed glass bulb throughout substantially the entire length of the glass bulb.

8 Claims, 6 Drawing Sheets

RARE GAS DISCHARGE LAMP

BACKGROUND OF THE INVENTION

The present invention relates to a rare gas discharge lamp manufactured by sealing a rare gas containing xenone gas as its main component into a tubular glass bulb in which a phosphor film is coated on its inner wall and by forming a pair of belt-shaped electrodes on the outer wall of the glass bulb.

In general, since a rare gas discharge lamp of this type has a small outer diameter and is of a rare gas discharge type, its brightness or discharge voltage is hardly influenced by an ambient temperature, and its service life is long. Therefore, the rare gas discharge lamp has attracted attention as an original reading light source of OA equipment such as a facsimile apparatus or an OCR or a back light of a liquid crystal display device.

In a conventional rare gas discharge lamp, however, as disclosed in U.S. Pat. No. 4,899,090, a pair of electrodes are enclosed at two ends of an elongated glass bulb, and a belt-shaped auxiliary electrode is formed in contact with the outer wall of the glass bulb between the two electrodes, thereby moving a positive column toward the auxiliary electrode side. Therefore, although a phosphor film near the auxiliary electrode can be effectively excited, it is difficult to efficiently excite the entire phosphor film. As a result, a bright discharge lamp cannot be easily obtained.

Japanese Patent Laid-Open No. 60-12660 discloses a fluorescent lamp in which mercury vapor is sealed into a glass bulb, and a pair of electrodes having various shapes such as a ring are formed on the outer wall of the glass bulb, thereby generating discharge in the bulb. In this fluorescent lamp, the electrodes are formed on the outer wall of the glass bulb to suppress sputtering caused by evaporation of an electrode material in the bulb. As a result, a reduction in luminous intensity is prevented to realize a long service life. However, since the mercury vapor is used as a discharge gas, not only the luminous intensity is low, but also a portion of a phosphor film opposing the electrode is damaged and degraded by mercury ions, thereby reducing a luminous flux. Therefore, since the luminous intensity of this fluorescent lamp is insufficient and its deterioration over time is large, it is difficult to use the fluorescent lamp as a light source of OA equipment.

SUMMARY OF THE INVENTION

The present invention has been made in consideration of the above situation and has as its object to provide a rare gas discharge lamp which can efficiently excite an internal phosphor film to obtain a sufficient light amount, can obtain stable discharge, and therefore can be suitably used as a light source of OA equipment.

In order to achieve the above object of the present invention, there is provided a rare gas discharge lamp, wherein a phosphor layer is coated on an inner wall of a tubular glass bulb, a predetermined amount of a rare gas containing xenone gas as a main component thereof is sealed and enclosed in the tubular glass bulb, and a pair of belt-shaped electrodes are formed on an outer wall of the enclosed glass bulb throughout substantially the entire length of the glass bulb.

A discharge gas for use in this rare gas discharge lamp does not contain a metal vapor such as mercury vapor, i.e., a rare gas containing xenone gas as its main component is sealed at a pressure of 30 to 100 torr. The width of each of a pair of belt-shaped electrodes formed on the outer wall of the glass bulb throughout the entire length of the bulb is set to be at least 1 mm. In addition, an insulating film is formed on the surface of the glass bulb having the belt-shaped electrodes. The glass bulb of this rare gas discharge lamp preferably consists of glass having a volume resistivity of $1\times10^9$ Ωcm at 150° C., e.g., lead glass. Disk-shaped enclosing glass having a melting point lower than that of the glass bulb main body is used at end faces to be enclosed of the glass bulb. The pair of belt-shaped electrodes are formed on the outer wall of the glass bulb so as to be inclined to form a "∧"-shaped structure.

When an RF voltage of 20 to 100 kHz and 1 to 2 kV is applied to the two belt-shaped electrodes, discharge of xenone gas is generated in a discharge space in the bulb in a direction perpendicular to the bulb axis, and the phosphor film on the inner wall of the bulb is excited to emit light. At this time, since the discharge gas is xenone gas not containing a metal vapor such as mercury vapor, the phosphor film is efficiently excited by exciting light (147 nm) of xenone gas to realize a high luminous intensity. In addition, since the phosphor film is not damaged by metal ions, degradation in the phosphor film is reduced to prevent a reduction in optical output.

When the width of the belt-shaped electrode is smaller than 1 mm, a discharge impedance is increased to reduce a discharge current. As a result, not only a sufficient luminous intensity cannot be obtained, but also discharge becomes unstable to cause flicker. However, a sufficient luminous intensity and stable discharge can be obtained by setting the width of the belt-shaped electrode to be 2 mm or more.

When an RF high voltage is applied to the internal discharge space of the rare gas discharge lamp through the glass bulb wall surface, the lamp generates heat due to an ohmic loss of the glass bulb. Therefore, if the rare gas discharge lamp is mounted on OA equipment and turned on, its tube wall temperature may be extraordinarily increased to cause a reduction in lamp efficiency or burnout of a power source. However, an extraordinary increase in lamp tube wall temperature can be prevented to realize stable discharge by using a glass bulb having a volume resistivity of $1\times10^9$ Ωcm or more at 150° C.

In addition, since the insulating film is coated on the surface of the glass bulb, a surface leakage or insulation breakdown can be prevented even if an RF high voltage of 1 kV or more is applied across the two belt-shaped electrodes.

Furthermore, since the low-melting disk-shaped enclosing glass is used at the end faces to be enclosed of the glass bulb, the end faces can be enclosed without producing an arcuated sag. Therefore, the discharge space can be used to the ends of the tube. Since the pair of belt-shaped electrodes are inclined to form a "∧"-shaped structure, a large light projecting window can be formed. In addition, since excitation light from the phosphor film can be effectively reflected by the belt-shaped electrodes toward the projecting window, a brighter light source can be obtained.

DETAILED DESCRIPTION OF THE PREFERRED EMBODIMENTS

A rare gas discharge lamp according to the present invention will be described in detail below with reference to the accompanying drawings.

Figure 1B:
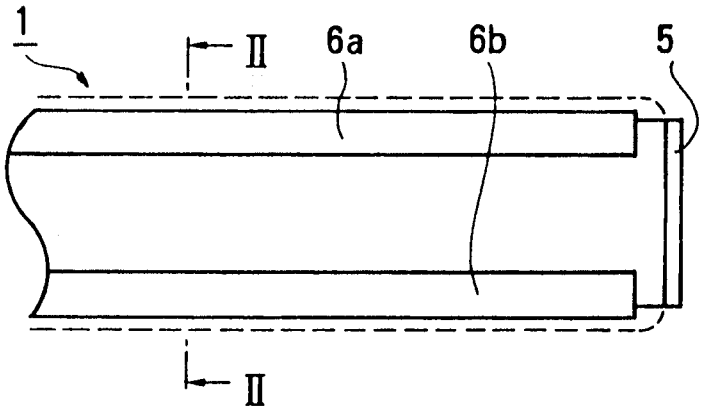
FIG. 1A and 1B are partially cutaway front view showing a rare gas discharge lamp according to the present invention.
Figure 1A:
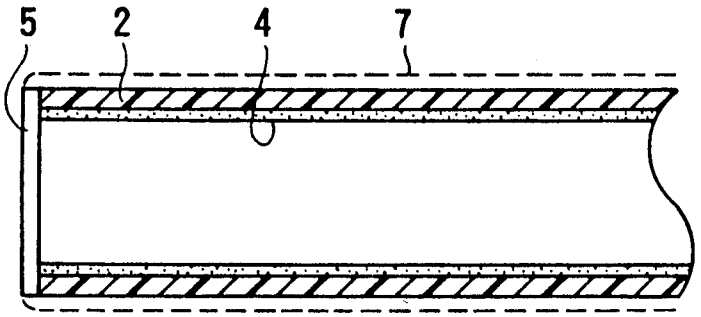
Figure 2:
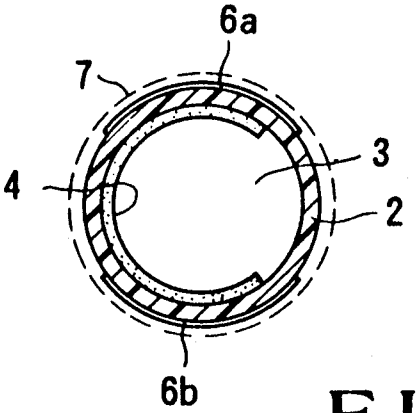
FIG. 2 is a sectional view taken along a line II—II in FIG. 1.

FIGS. 1 and 2 show a rare gas discharge lamp 1 according to the present invention. In FIGS. 1 and 2, reference numeral 2 denotes a straight tubular glass bulb, and a phosphor film 4 is coated on the inner surface of the bulb 2 throughout substantially the entire length in the axial direction of the bulb 2 except for a light projecting window 3. Reference numeral 5 denotes disc-shaped enclosing glass for enclosing two end faces of the glass bulb 2. The sealing glass 5 consists of low-melting glass (high-lead glass) having a melting point lower than that of the glass bulb 2. A rare gas containing xenone (Xe) gas as its main component is sealed in the enclosed glass bulb 2 at a gas pressure of 30 to 100 torr. Belt-shaped electrodes 6*a* and 6*b* each consisting of an aluminum foil and having a predetermined length are formed on the outer wall of the glass bulb 2 at two sides along the light projecting window 3. The electrodes 6*a* and 6*b* are formed in contact with the glass bulb 2 throughout substantially the entire bulb length and oppose each other. A transparent insulating film 7 consisting of a silicone resin is coated on the glass bulb 2 including the belt-shaped electrodes 6*a* and 6*b*.

Figure 3:
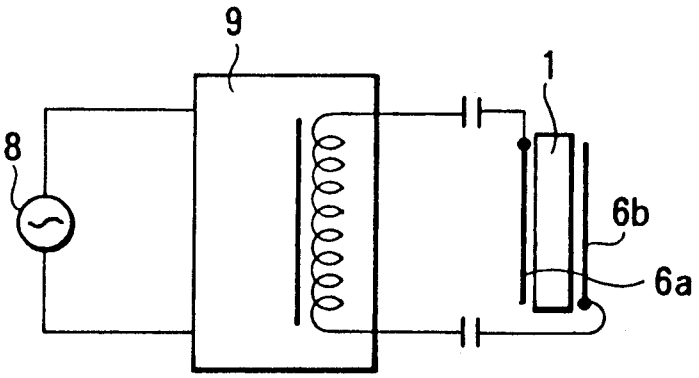
FIG. 3 is a diagram showing a turn-on circuit of the rare gas discharge lamp.

As shown in FIG. 3, the belt-shaped electrodes 6*a* and 6*b* of the rare gas discharge lamp 1 having the above structure are connected to an AC power source 8 via an RF turn-on circuit 9, and a predetermined RF high voltage of, e.g., 30 kHz and 1,600 V is applied across the electrodes 6*a* and 6*b*. As a result, the rare gas discharge lamp 1 generates discharge (exciting line wavelength = 147 nm) of xenone gas in the internal space of the glass bulb 2 interposed between the belt-shaped electrodes 6*a* and 6*b*. The phosphor film 4 in the glass bulb 2 is excited by this xenone gas discharge, and visible light emitted by the phosphor film 4 is externally radiated from the light projecting window 3.

The constituting components of the rare gas discharge lamp 1 having the above structure were examined by various tests.

Firstly, the present inventors made samples #1 to #6 by changing an electrode width W of the belt-shaped electrodes 6*a* and 6*b* by six stages from 1 to 6 mm and observed an illuminance and an ON state of each sample. The observation results are summarized in Table 1.

In this test, in each of the six samples, a soda glass bulb having an outer diameter of 6 mm, a thickness of 0.5 mm, and a length of 300 mm ($\phi 6 \times 0.5^t \times 300^L$) was used as the glass bulb 2, an aluminum foil having a width of W mm and a length of 300 mm was used as each of the belt-shaped electrodes 6*a* and 6*b*, and xenone gas was sealed as the gas to be sealed at a pressure of 65 torr. Each sample was turned on and evaluated with an applied voltage of 1,600 V at 28 kHz. Note that in Table 1, ($\theta$°) of a belt-shaped electrode is a calculated value of an angle defined between the belt-shaped electrode of each sample and the bulb central axis and indicated as a reference value.

TABLE 1

Effect of Electrode Width of Belt-Shaped Electrode

| Sample No. | Width of Belt-Shaped Electrode W mm ($\theta$°) | Lamp Current (mA) | Illuminance (Lx) | ON State |
|---|---|---|---|---|
| #1 | 1 (20°) | — | — | Unstable Flicker |
| #2 | 2 (40°) | 12.7 | 4040 | Unstable For 2 to 3 Min. After Turned On |
| #3 | 3 (60°) | 16.2 | 5530 | Stable |
| #4 | 4 (77°) | 20.2 | 7150 | Stable |
| #5 | 5 (95°) | 22.1 | 7730 | Stable |
| #6 | 6 (115°) | 25.5 | 9420 | Stable |

*Illuminance was measured at an intermediate-diameter position of each bulb separated from the outer wall by 8 mm.

As is apparent from Table 1, the illuminance of the sample #1 is low, and discharge forms a stripe pattern to cause flicker. The sample #2 is unstable for two to three minutes after it is turned on and then stabilized. The illuminance of the sample #2 is substantially the same as that of a conventional internal electrode type rare gas discharge lamp. As the electrode width is increased from 3 to 6 mm in the samples #3 to #6, discharge becomes more stable, and the illuminance of these samples are increased by far from 5,530 to 9,420 Lx as compared with 4,500 Lx of a conventional discharge lamp. The reason for the above results are assumed as follows. That is, in the sample #1, since a small electrode area makes it difficult to obtain a sufficient discharge current, discharge flickers and is low. In each of the samples #3 to #6, since a sufficient discharge current can be obtained by a large electrode area, a high illuminance and stable discharge can be obtained. Note that since an interelectrode leakage (surface discharge) is produced from the glass bulb surface of each sample upon voltage application, a protection film of the insulating film is preferably formed.

Figure 4:
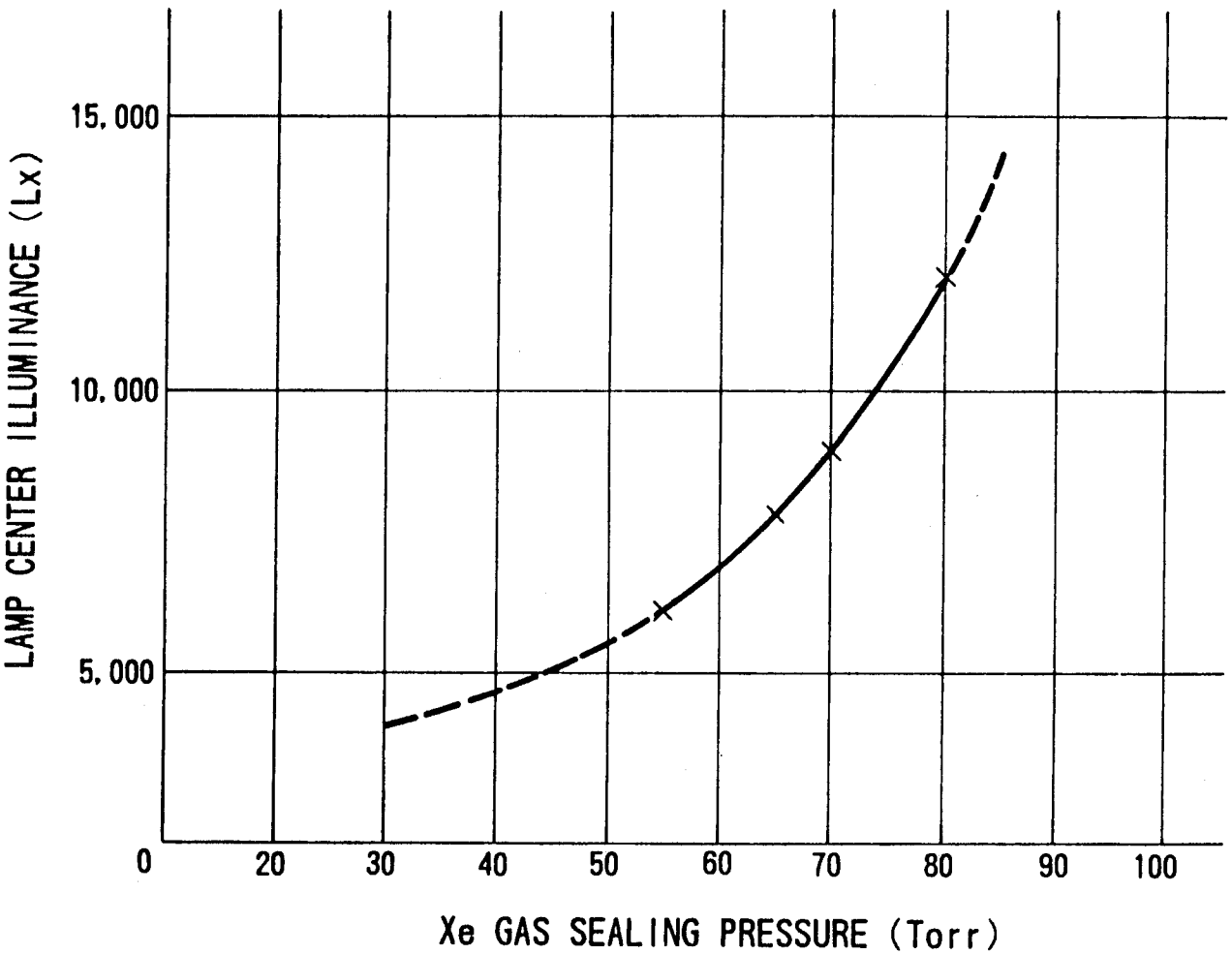
FIG. 4 is a graph showing a relationship between a sealing gas pressure and an illuminance of the rare gas discharge lamp shown in FIG. 1.

The present inventors changed the gas pressure of the sealed xenone gas of the sample #5 within the range of 55 to 80 torr to make samples #7 (55 torr), #8 (65 torr), #9 (70 torr), and #10 (80 torr), and turned on each sample with an RF power source of 28 kHz and 1,600 V to measure its illuminance. As a result, a curve A as shown in FIG. 4 was obtained.

An illuminance obtained by a conventional internal electrode type rare gas discharge lamp is about 4,500 Lx. In order to obtain this illuminance by the rare gas discharge lamp of the present invention, a sealing pressure need only be at least 45 torr or more with a power source of 28 kHz and 1,600 V. Although a higher illuminance can be obtained as the sealing pressure is increased, the lamp flickers when the pressure is increased to be 100 torr or more. In order to prevent this flicker, an applied voltage of 2,000 V is undesirably required.

Therefore, the sealing pressure is preferably 45 to 100 torr.

The present inventors then changed ON frequencies of the samples #7 (55 torr), #8 (65 torr), and #10 (80 torr) within the range of 20 to 100 kHz and measured their illuminances and ON states. As a result, curves B, C, and D shown in FIG. 5 were obtained.

Figure 5:
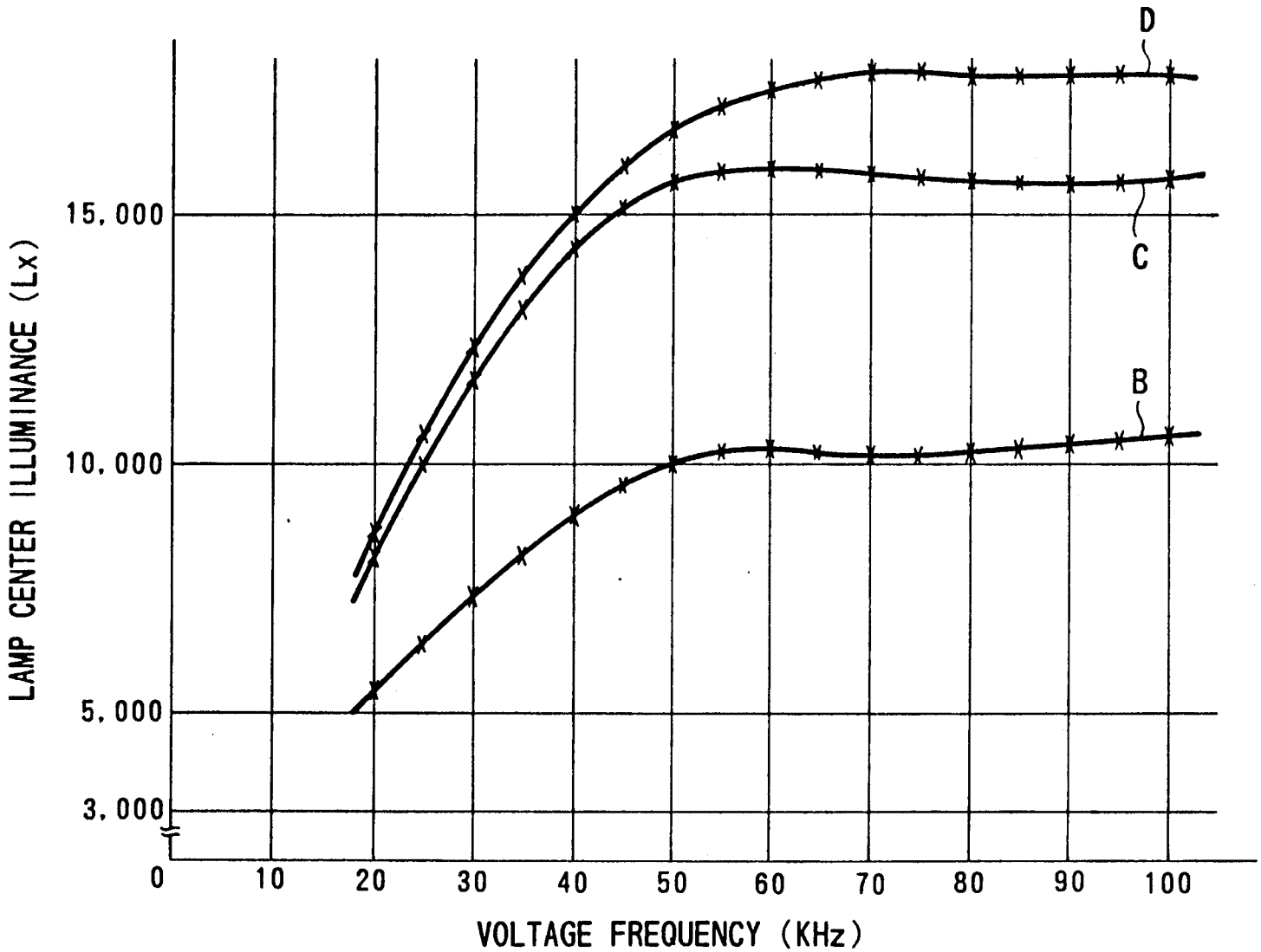
FIG. 5 is a graph showing a relationship between an RF frequency and an illuminance of the rare gas discharge lamp shown in FIG. 1.

As shown in FIG. 5, although the illuminance of each sample is increased as its ON frequency is increased, a current is reduced to cause flicker in discharge at a low frequency of 15 kHz. In addition, when the frequency exceeds 100 kHz, the illuminance is not much increased, i.e., efficiency is decreased. Therefore, the ON frequency is preferably 20 to 100 kHz.

Also, the present inventors found the following problem. That is, in the ON test of the discharge lamps described above, no particular problem is posed in the rare gas discharge lamp at a room-temperature atmosphere (25° C.). However, when the lamp is turned on at a high-temperature atmosphere at 55° C. or more, the tube wall temperature of the glass bulb is extraordinarily increased to reduce an luminous efficacy and, in some cases, burn out an RF power source.

The present inventors made extensive studies and obtained the following conclusion. That is, the glass bulb 2 of the rare gas discharge lamp 1 generates heat due to a current flowing therethrough, and this heat further reduces a resistance and increases a current value. As a result, the tube wall temperature of the glass bulb is increased to extraordinarily increase the lamp current, thereby burning out an RF power source. Therefore, the present inventors solved this problem by selecting a glass bulb having a high resistivity and, more particularly, a glass bulb having a volume resistivity of $1\times10^9$ Ωcm or more at a high temperature of 150° C.

Examples of a glass material which satisfies the above condition are quartz glass and pyrex. However, lead glass is preferable since it is inexpensive and can be easily processed.

Figure 6:
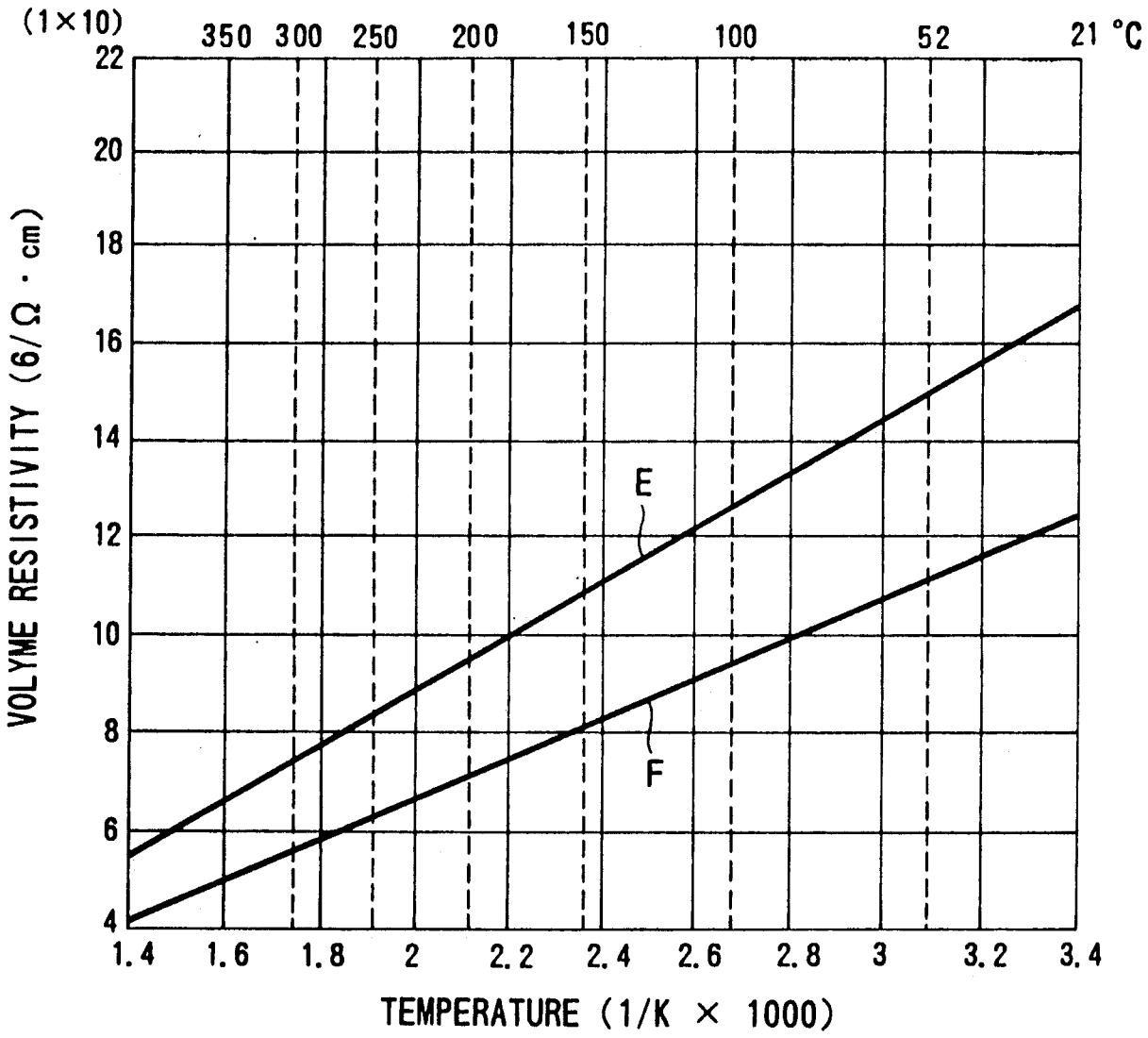
FIG. 6 is a graph showing a relationship between a volume resistivity of a glass bulb and its temperature of the rare gas discharge lamp shown in FIG. 1.

FIG. 6 shows temperature-to-volume resistivity curves of soda glass and lead glass. In FIG. 6, a curve E indicates lead glass, and a curve F indicates soda glass. As shown in FIG. 6, both of lead glass and soda glass have high resistivities of $1\times10^{12}$ Ωcm or more at room temperature. At a temperature of 150° C., however, although the resistivities of both of lead glass and soda glass are reduced to be $1\times10^{11}$ and $2\times10^8$ Ωcm, respectively, the resistivity of lead glass is 1,000 times or more that of soda glass.

FIGS. 7 to 10 show ON test results comparing lead glass with soda glass as the material of the glass bulb of the rare gas discharge lamp 1, in each of which a curve G indicates lead glass and a curve H indicates soda glass.

Figure 7:
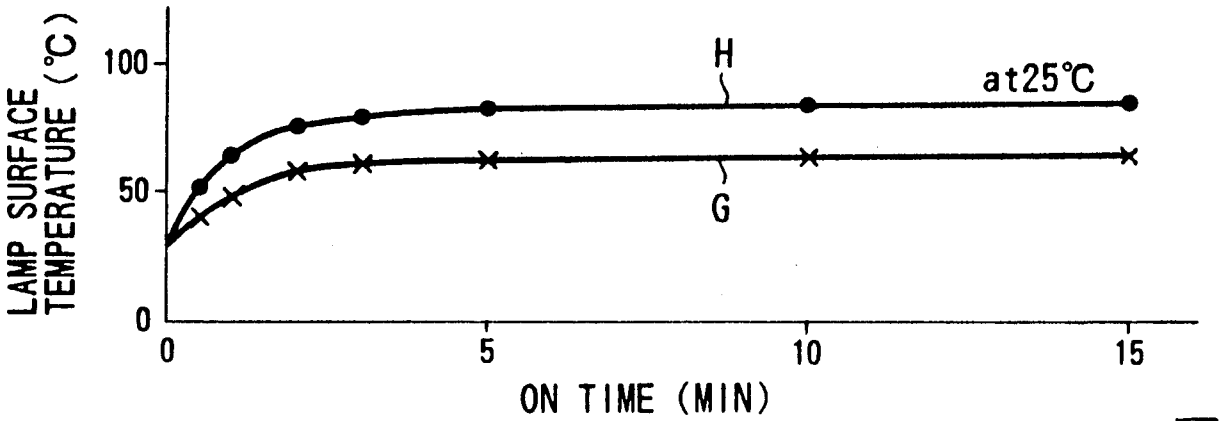
FIGS. 7 to 10 are graphs each showing a relationship between an ON ambient temperature and lamp characteristics obtained by changing the material of the glass bulb of the rare gas discharge lamp shown in FIG. 1.
Figure 8:
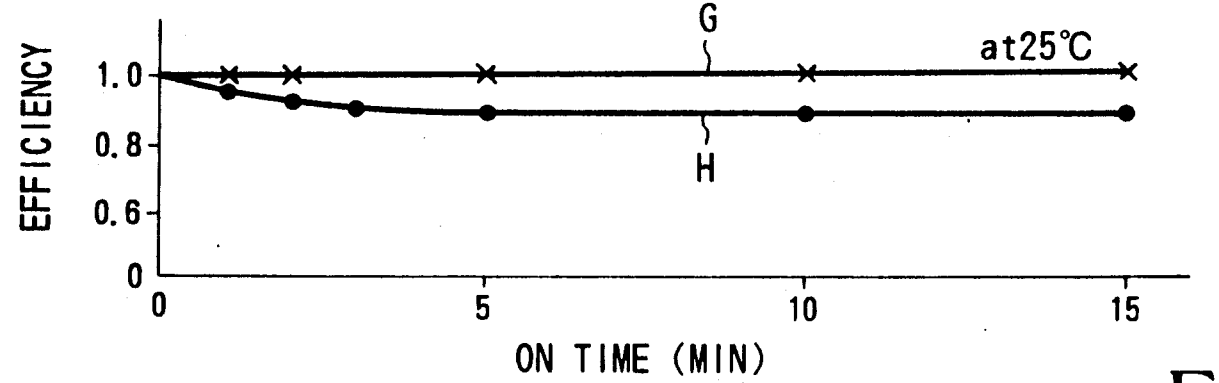
Figure 9:
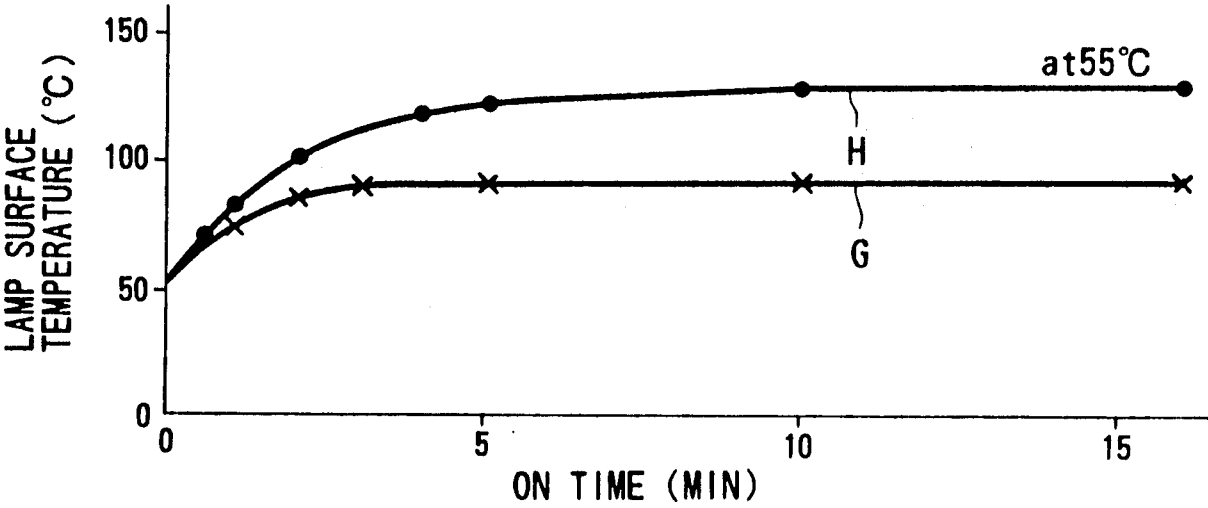
Figure 10:
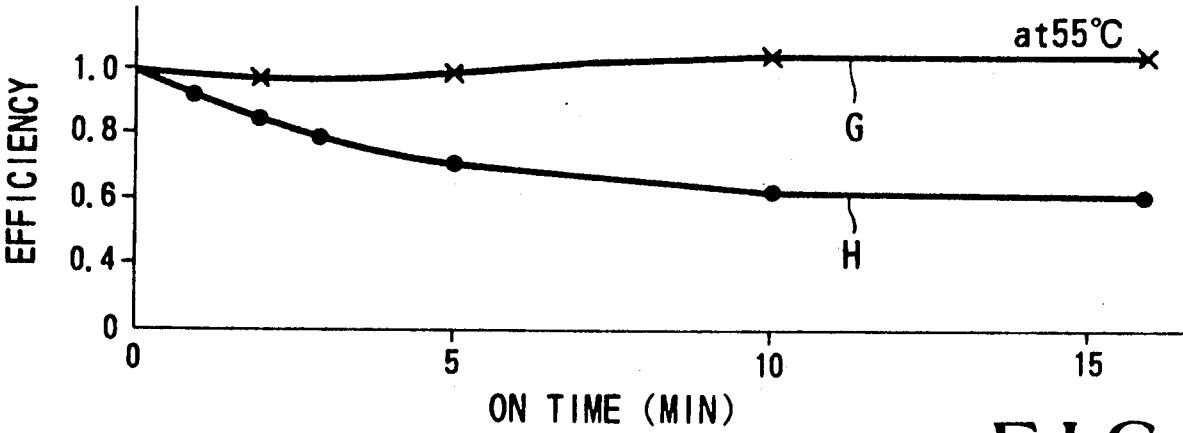

FIGS. 7 and 8 show ON test results obtained at an ambient temperature of 25° C., and FIGS. 9 and 10 show ON test results obtained at an ambient temperature of 55° C. FIGS. 7 to 10 show a lamp tube wall surface temperature and a change over time in efficiency (a ratio of an illuminance to an input current).

The lamp made of a soda glass bulb indicated by the curve H is substantially stabilized for one to two minutes in an ON state at 25° C. but is not stabilized for 10 minutes or more in an ON state at 55° C. In particular, the tube wall temperature of this lamp exceeds 100° C. and reaches 120° C. in an ON state at 55° C.

To the contrary, the lamp made of a lead glass bulb indicated by the curve G is substantially stabilized for one to two minutes in ON states at both of 25° C. and 55° C. In addition, the tube wall temperature of this lamp is held at 90° C. to 100° C. even in an ON state at 55° C.

Figure 11:
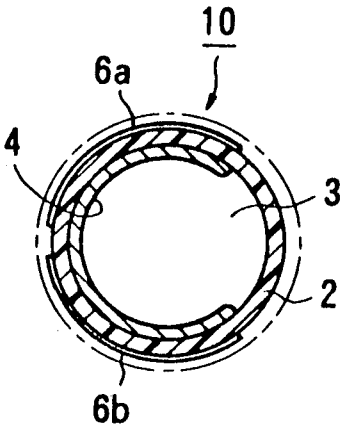
FIG. 11 is a sectional view showing a rare gas discharge lamp according to another embodiment of the present invention.

FIG. 11 shows another embodiment of the present invention. In a rare gas discharge lamp 10 shown in FIG. 11, a pair of belt-shaped electrodes 6*a* and 6*b* formed on the outer wall of a glass bulb 2 of a rare gas discharge lamp 1 shown in FIG. 1 are inclined to form a branch. In FIG. 11, the same reference numerals as in FIG. 1 denote the same parts and a detailed description thereof will be omitted. With this arrangement, a light projecting window 3 can be made larger than that obtained in the arrangement in which the belt-shaped electrodes 6*a* and 6*b* oppose straight each other via the glass bulb 2. In addition, exciting light converted by a phosphor film 4 can be reflected by the branched belt-shaped electrodes 6*a* and 6*b* and effectively projected through an opening of the opposing light projecting window 3.

As has been described above, in the rare gas discharge lamp according to the present invention, a rare gas containing xenone gas as its main component is sealed enclosed at a predetermined pressure in a cylindrical glass bulb in which a phosphor film coated on its inner wall, a pair of belt-shaped electrodes each having a predetermined width are formed on the outer wall of the glass bulb to oppose each other, and an RF voltage is applied across the two electrodes. Therefore, since stable discharge can be obtained with a sufficient light amount, an excellent OA equipment light source can be provided.

What is claimed is:

1. A rare gas discharge lamp, wherein a phosphor layer is coated on an inner wall of a tubular glass bulb, a predetermined amount of rare gas containing xenon gas as a main component thereof is sealed and enclosed in said tubular glass bulb, a pair of belt-shaped electrodes are formed on an outer wall of said enclosed glass bulb throughout substantially the entire length of said glass bulb, and an insulating film is coated on said glass bulb between said beltshaped electrodes.

2. A lamp according to claim 1, wherein the rare gas is sealed at a pressure of 45 to 100 torr.

3. A lamp according to claim 1, wherein a width of each belt-shaped electrode is set to be not less than 1 mm.

4. A lamp according to claim 1, wherein said insulating film is coated on said glass bulb as well a said belt-shaped electrodes.

5. A lamp according to claim 1, wherein said glass bulb consists of glass having a volume resistivity of not less than $1\times10^9$ Ωcm.

6. A lamp according to claim 1, wherein said glass bulb consists of lead glass.

7. A lamp according to claim 1, wherein end faces to be enclosed of said glass bulb are enclosed by disk-shaped enclosing glass having a melting point lower than that of said glass bulb.

8. A lamp according to claim 1, wherein an RF voltage of 20 to 100 kHz is applied to said pair of belt-shaped electrodes.

* * * * *

US005117160C1

(12) REEXAMINATION CERTIFICATE (4403rd)

United States Patent

Konda et al.

(10) Number: US 5,117,160 C1

(45) Certificate Issued: Jul. 31, 2001

(54) RARE GAS DISCHARGE LAMP

(75) Inventors: Tsutomu Konda; Seiichiro Fujioka; Satoshi Tamura; Osamu Matsubara; Shodo Yoshida, all of Osaka (JP)

(73) Assignees: NEC Corporation, Tokyo; NEC Home Electronics Ltd., Osaka, both of (JP)

Reexamination Request:
No. 90/004,547, Feb. 11, 1997

Reexamination Certificate for:

| | |
|---|---|
| Patent No.: | **5,117,160** |
| Issued: | **May 26, 1992** |
| Appl. No.: | **07/540,326** |
| Filed: | **Jun. 19, 1990** |

(30) Foreign Application Priority Data

| | | |
|---|---|---|
| Jun. 23, 1989 | (JP) | 1-161958 |
| Sep. 29, 1989 | (JP) | 1-115236 U |
| Dec. 29, 1989 | (JP) | 1-340171 |
| Mar. 28, 1990 | (JP) | 2-080486 |

(51) Int. Cl.[7] ..... H01J 11/04

(52) U.S. Cl. ..... 315/326; 313/607

(58) Field of Search ..... 313/621, 623, 313/624, 625, 631, 636, 607, 488, 439; 315/326

(56) References Cited

U.S. PATENT DOCUMENTS

| | | | | |
|---|---|---|---|---|
| 2,468,221 | * | 4/1949 | Miller | 313/623 |
| 3,693,007 | * | 9/1972 | Kerekes | 313/623 |
| 4,846,832 | * | 7/1989 | Wichterle | 623/6 |
| 4,847,118 | * | 7/1989 | Oshima et al. | 427/275 |
| 5,013,966 | * | 5/1991 | Saikatsu et al. | 313/493 |

FOREIGN PATENT DOCUMENTS

| | | |
|---|---|---|
| 61-185857 | 8/1986 | (JP) . |
| 63-98163 | 4/1988 | (JP) . |
| 63-146343 | 6/1988 | (JP) . |
| 1-231260 | 9/1989 | (JP) . |

OTHER PUBLICATIONS

*Dictionary of Glass*, Sep. 20, 1985.

*Glass for Electronic Parts*, Sep. 1984.

*New Trends in High Intensity UV Generation*, Mar., 1988, B. Eliasson, et al., EPA Newsletter; pp. 29–40.

* cited by examiner

*Primary Examiner*—Michael B Shingleton

(57) ABSTRACT

A phosphor layer is coated on an inner wall of a tubular glass bulb. A predetermined amount of a rare gas containing xenon gas as a main component thereof is sealed and enclosed in the tubular glass bulb. A pair of belt-shaped electrodes are formed on an outer wall of the enclosed glass bulb throughout substantially the entire length of the glass bulb.

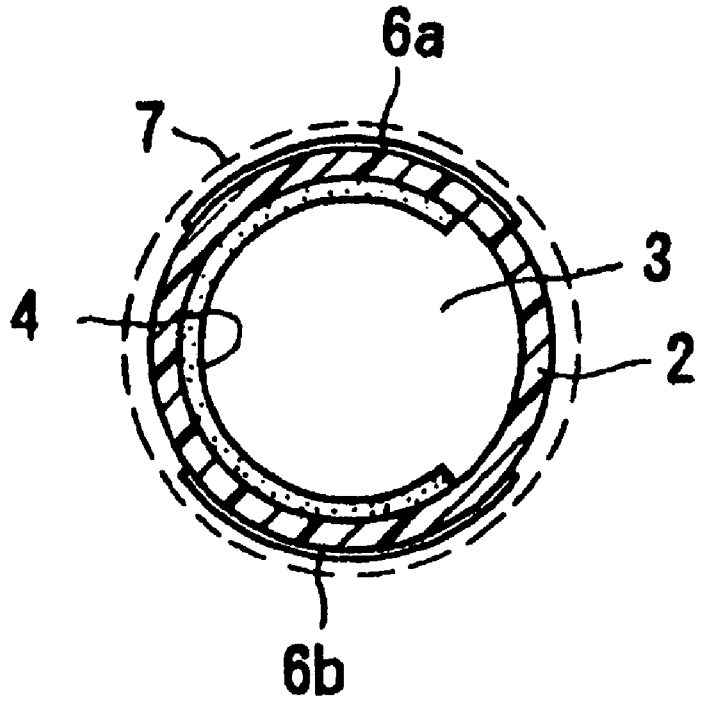

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 7 is confirmed.

Claims 1–6 and 8 are cancelled.

* * * * *